US005299660A

United States Patent [19]

Farmer

[11] Patent Number: 5,299,660

[45] Date of Patent: Apr. 5, 1994

[54] STATIONARY LIFT STRUCTURE WITH STERILE-TYPE ENCLOSURE FOR PHARMACEUTICAL AND MEDICAL APPLICATIONS

[76] Inventor: Ervin H. Farmer, P.O. Box 185, Sharpsburg, N.C. 27878

[21] Appl. No.: 68,782

[22] Filed: Jun. 1, 1993

[51] Int. Cl.[5] ..... B66B 9/20

[52] U.S. Cl. ..... 187/9 R; 187/36; 187/1 R; 414/607

[58] Field of Search ..... 187/1 R, 9 R, 17, 34, 187/36, 40, 98, DIG. 1, 29.2, 110; 224/151, 272, 273; 414/607, 608, 785

[56] References Cited

U.S. PATENT DOCUMENTS

| | | | |
|---|---|---|---|
| 3,905,453 | 9/1975 | Frank | 187/1 R X |
| 4,091,906 | 5/1978 | Clarke et al. | 187/1 R X |
| 4,632,627 | 12/1986 | Swallows | 187/9 R X |
| 4,677,779 | 7/1987 | Rodriguez | 187/1 R X |
| 5,220,980 | 6/1993 | Petter | 187/9 R |

FOREIGN PATENT DOCUMENTS

| | | | |
|---|---|---|---|
| 52-47246 | 10/1975 | Japan | 187/1 R X |

*Primary Examiner*—Robert P. Olszewski
*Assistant Examiner*—Dean A. Reichard
*Attorney, Agent, or Firm*—Rhodes, Coates & Bennett

[57] ABSTRACT

The present invention entails a stationary lift structure for supporting and handling goods and articles and which is particularly designed for use in pharmaceutical or medical-type applications because of the utilization of a sterile-type enclosure for the various components that comprise the stationary lift structure. Structurally, the lift device includes a mainframe that is adapted to rest on a support surface. The mainframe includes a pair of upstanding guide rails. Movably mounted on the guide rails is a carriage that carries a bed structure that can be moved between a lower position just above the support surface and an elevated position. A pneumatically driven hydraulic fluid control system is employed to drive the carriage and load the bed structure from its lower position to an upper elevated position. A tie or carrier bar is adapted to interconnect the mainframe structure with the bed structure such that the entire lift support structure can be picked up and moved by simply engaging and lifting the bed structure of the device.

12 Claims, 6 Drawing Sheets

STATIONARY LIFT STRUCTURE WITH STERILE-TYPE ENCLOSURE FOR PHARMACEUTICAL AND MEDICAL APPLICATIONS

FIELD OF INVENTION

The present invention relates to stationary or non-mobile lift structures for use in medical and pharmaceutical applications and particularly designed to lift and support goods, packages, articles and the like at a selected elevation above a floor or support surface so as to facilitate the handling of the goods or products by workers.

BACKGROUND OF THE INVENTION

In pharmaceutical facilities workers are required to package and handle containers and the like in a sterile and clean environment. Because of strict requirements relative to maintaining a sterile and clean environment within a pharmaceutical or medical production facility, pharmaceutical and medical companies have not had wide access to state-of-the art equipment, particularly material handling equipment.

One particular problem that has plagued both the pharmaceutical and the medical production industry is the problem of appropriately positioning goods and products for workers to work with and handle. For example, there has long been a need for a lift structure that will support containers or products at an appropriate elevated position above the floor level such that workers can easily and conveniently handle and work with the product. Simply stated, the inventor is unaware of a stationary lift device that is designed and engineered for sterile applications and which is appropriate for use in the medical and pharmaceutical facilities industry.

SUMMARY AND OBJECTS OF THE INVENTION

The present invention entails a stationary lift structure that is designed to be utilized in a sterile and clean environment. In particular, the lift structure of the present invention includes a mainframe structure that is designed to rest on a floor or other type of support surface. Movably mounted to the mainframe is a bed structure that moves up and down between a lower position and an upper elevated position. This bed structure can be stationed at any elevated point between the lower position and the uppermost elevated position.

The lift structure includes an upright housing structure that is preferably enclosed by stainless steel which imparts to the entire structure a sterile design and makes this stationary lift structure compatible with pharmaceutical and medical production facilities.

It is therefore a principal object of the present invention to provide a stationary lift structure that is compatible with environments that require sterile and clean equipment.

Another object of the present invention is to provide a stationary lift structure that can be efficiently and effectively used in both pharmaceutical and medical production facilities.

Another object of the present invention is to provide a stationary lift structure of the character referred to above which can be easily and conveniently moved from one location to another location within such a facility.

It is also an object of the present invention to provide a stationary lift structure of the character referred to above that is provided with means for tying together the mainframe and load bed structure such that the entire lift structure can be picked up and moved from one location to another by simply engaging and lifting the load bed structure.

Another object of the present invention resides in the provision of a sterile stationary lift structure that includes a load bed structure that can be moved between two extreme positions and wherein the load bed structure can be fixed and stationed at any position between the two extreme positions.

A further object of the present invention is to provide a stationary lift device of the character referred to above that includes means for controlling the final descent of the load bed in such a fashion as to prevent the same from being lowered onto the feet of an individual standing around and in the vicinity of the load bed.

Other objects and advantages of the present invention will become apparent and obvious from a study of the following description and the accompanying drawings which are merely illustrative of such invention.

DETAILED DESCRIPTION OF THE INVENTION

With further reference to the drawings, the stationary lift device of the present invention is shown therein and indicated generally by the numeral 10.

Figure 3:
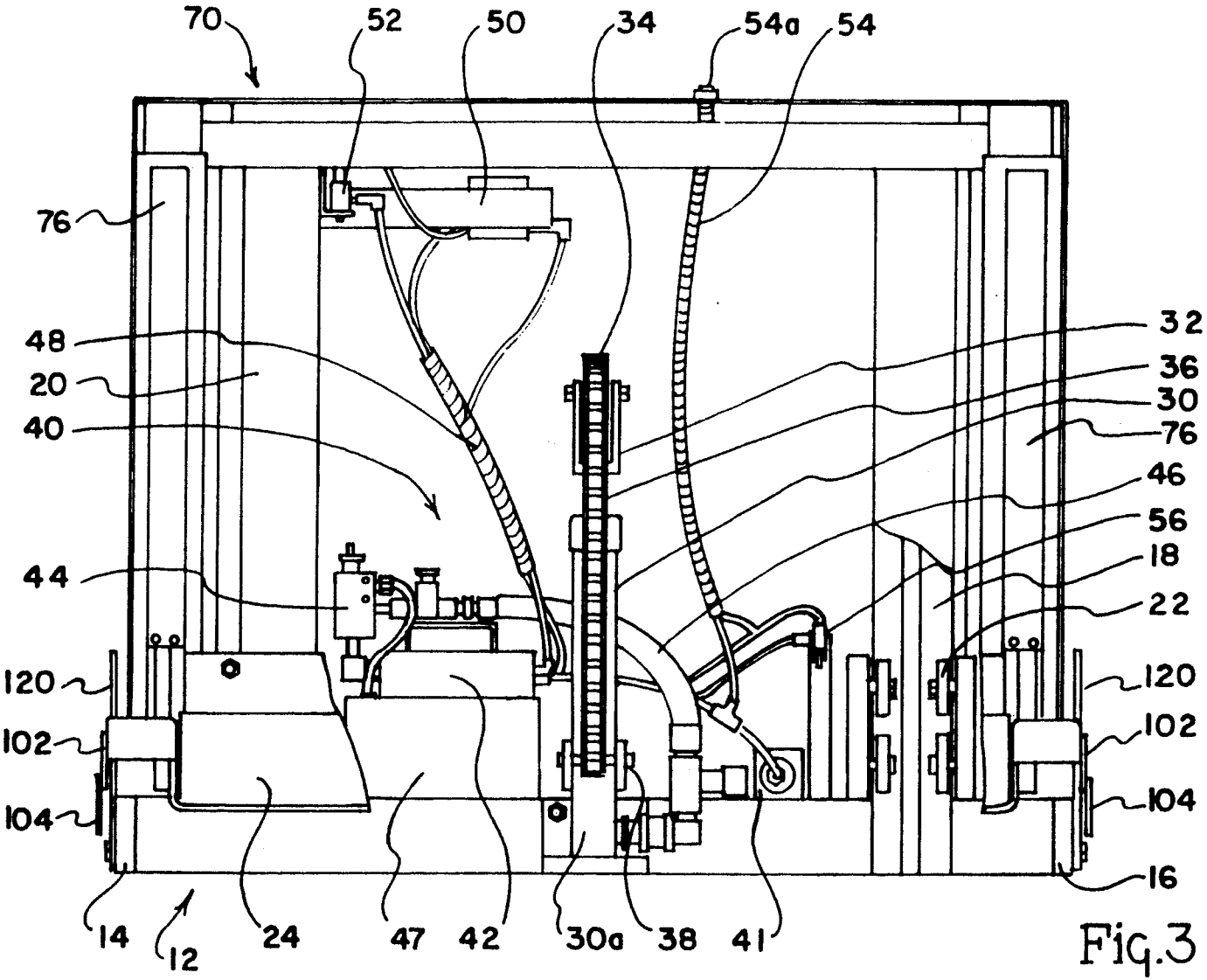
FIG. 3 is a rear elevational view of the upright housing structure forming a part of the upright housing structure forming a part of the lift device with the rear side housing wall being removed to illustrate the components of the lift device.
Figure 4:
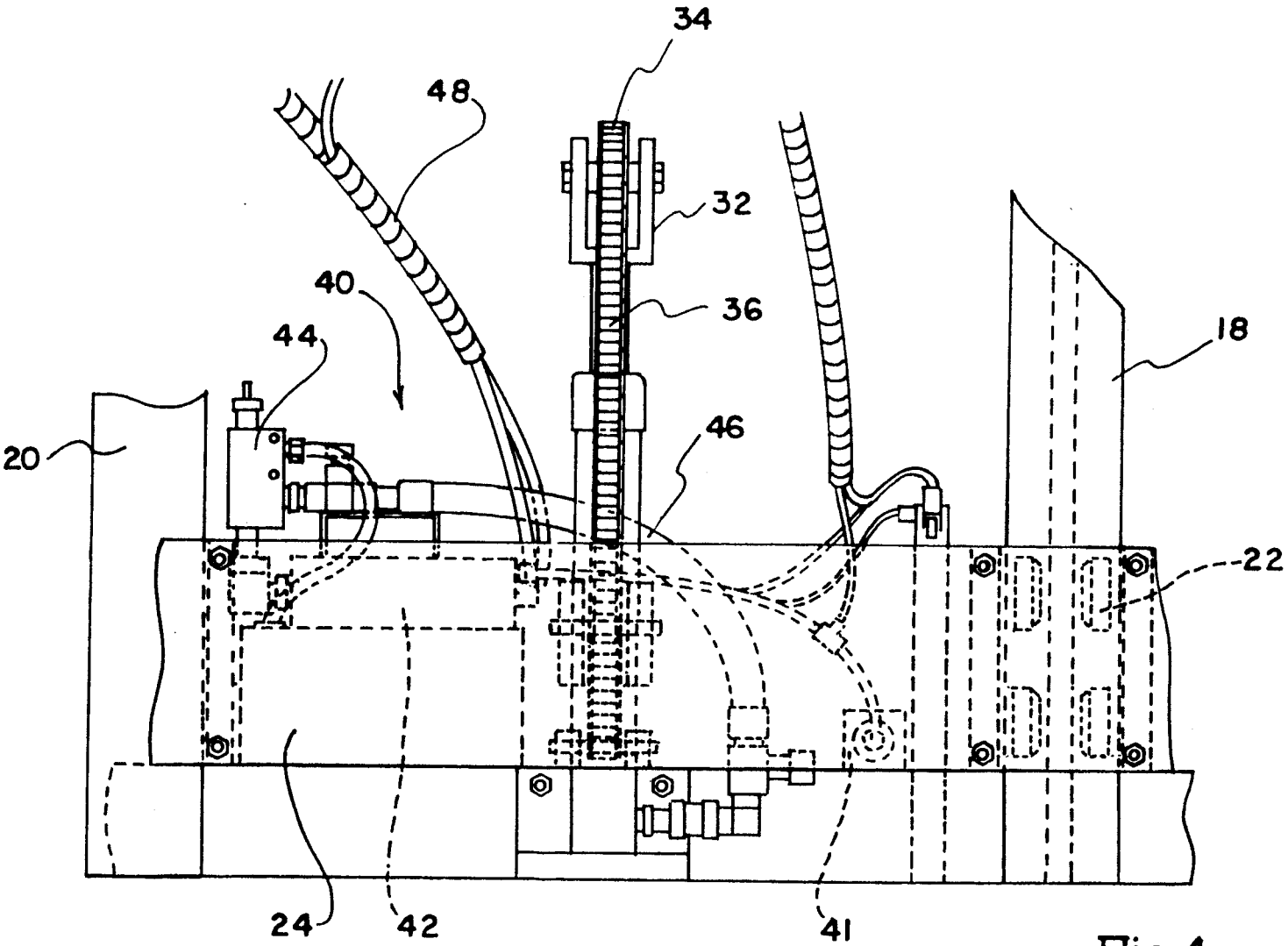
FIG. 4 is a fragmentary rear view of the upright housing with the back wall of the housing removed to illustrate various components of the structure along with a part of the carriage structure.

Lift device 10 includes a mainframe indicated generally by the numeral 12. Mainframe 12 is designed to rest on a floor structure or other type of support structure. Forming a part of the mainframe 12 is a pair of spaced apart base legs 14 and 16 that are connected together to form a base frame structure. Extending upwardly from one end of the base frame is a pair of I-beams 18 and 20. The purpose of the I-beams 18 and 20 is to accept and support a pair of carriages 22 that move up and down the I-beams. As seen in FIGS. 3 and 4, each carriage 22 includes four wheels that are confined within a respective I-beam 18 or 20 and each carriage 22 is adapted to move up and down the I-beam. Secured to both carriages 22 is a cross member 24 that moves up and down with the carriages 22.

Secured to the cross member 24 and extending generally normal thereto is a pair of laterally spaced lift arms 26. It is appreciated that the lift arms move up and down with the cross member 24 and the carriages 22. Supported on the laterally spaced arms 26 is a load bed structure 28 that in the case of the lift device 10 is designed to be used in a pharmaceutical or medical facility and would be constructed of a sterile-type material such as stainless steel.

Therefore, it is appreciated that as the carriages 22 move up and down in the I-beams 18 and 20, that the laterally spaced arms 26 as well as the load bed structure 28 move up and down at the same time.

To drive the arms 26 and load bed structure 28 up and down, there is provided an upstanding hydraulic cylinder 30 that is particularly shown in FIGS. 3 and 4. Hydraulic cylinder 30 includes an anchor end 30*a* that is secured about the base frame. Extending upwardly from the top portion of hydraulic cylinder 30 is a rod that has a clevis 32 connected thereto. Clevis 32 has a rotatably mounted sprocket 34. A chain 36 is trained around the sprocket 34 and is anchored about the base of the hydraulic cylinder by chain anchor brackets 38. The remote end of the chain 36 is a fixed to the cross member 24 and consequently it is appreciated as the rod of the hydraulic cylinder 30 is extended that such action will result in the entire load bed assembly or structure being raised. It should be pointed out that because of the arrangement of the hydraulic cylinder 30, sprocket 34 and chain 36, that for every inch of travel of the rod of the hydraulic cylinder that the load bed assembly moves a corresponding two inches.

Figure 1:
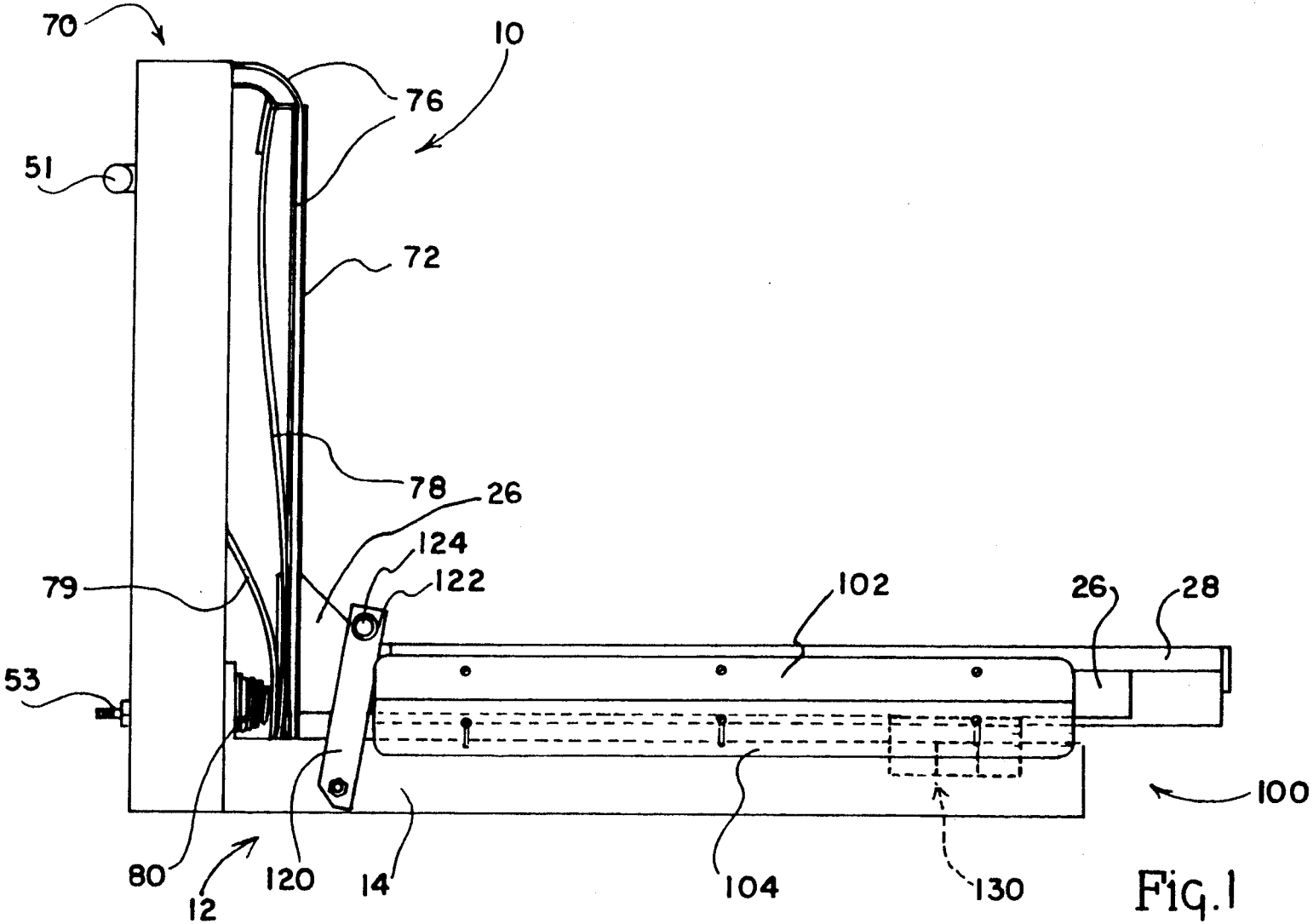
FIG. 1 is a side elevational view of the stationary lift device with a portion of the side wall structure being broken away to better illustrate components of the device located within the left side housing structure.
Figure 2:
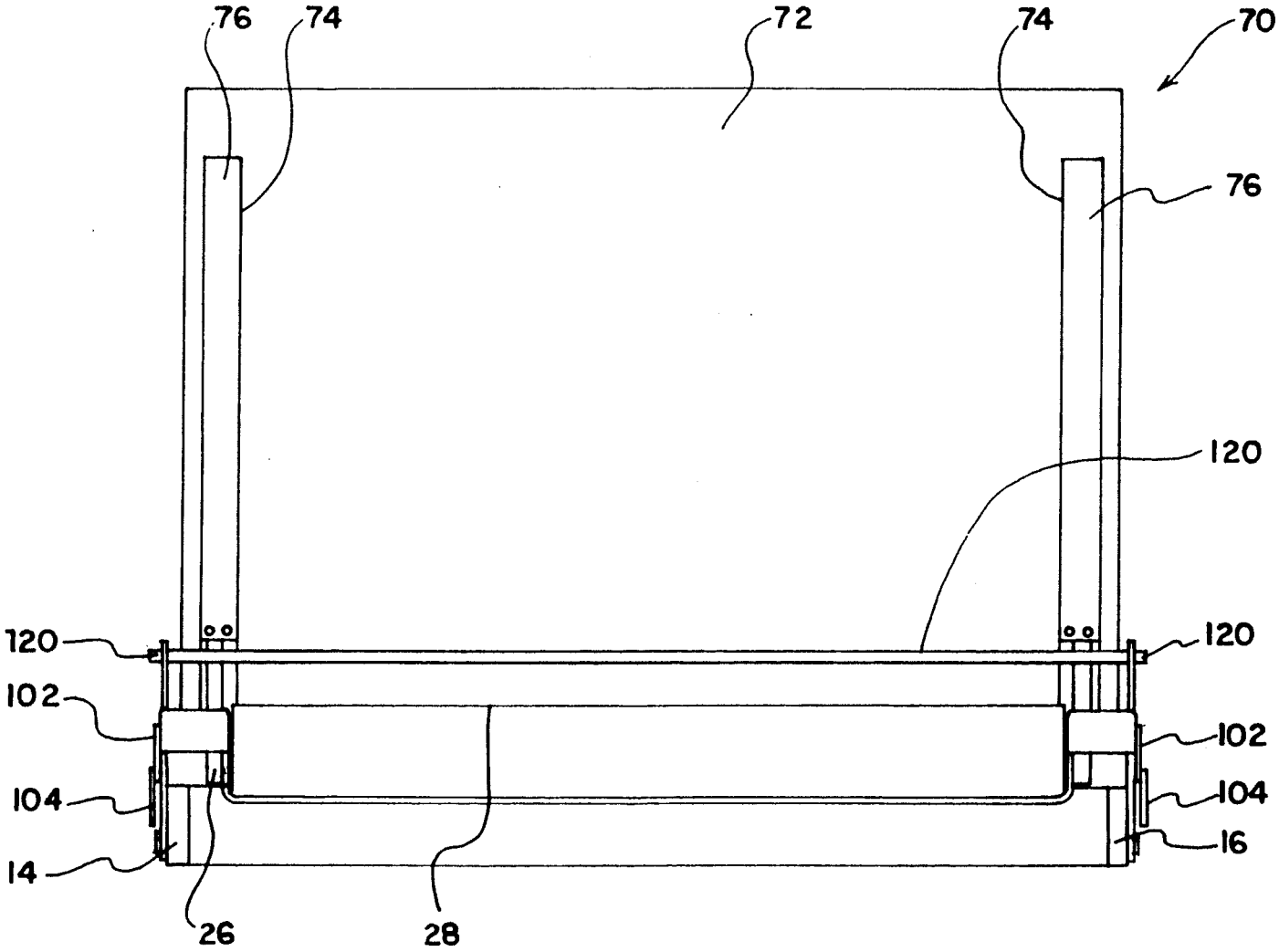
FIG. 2 is an end elevational view viewed from the right side of the lift device as shown in FIG. 1.

To actuate and drive the hydraulic cylinder 30, there is provided a pneumatic powered fluid drive system that is indicated generally by the numeral 40. With particular reference to FIGS. 3 and 4, it is seen that the fluid drive system 40 includes a pneumatic motor 42 that, as will be subsequently discussed, is connected to various controls and which is connected to an air supply via input air lines 41. It is seen that input air line 41 extends through a housing structure and includes an air inlet 53 disposed on the lower portion of the housing structure as shown in FIG. 1. Associated with the fluid drive system 40 is a pressure controller 44 that cooperates with the pneumatic motor 42 to supply hydraulic fluid under pressure to a supply line 46 that is operative to convey hydraulic fluid from a reservoir 47 to the base or anchor end of the hydraulic cylinder 30.

A main control line 48 extends to the pneumatic motor 42 and is also connected to a control valve 50 which is operated by a control handle 51 that is stationed on the outside of the housing structure as shown in FIG. 1. Also connected to main control line 48 is an upper limit switch 52 that is shown in FIG. 3 and is adapted to be engaged by the cross member 24. The engagement of the cross member 24 with the upper limit switch 52 causes the pneumatic motor 42 to be shut down and consequently causes the cross member 24 and the load bed structure 28 to be halted at a selected elevation or height above the underlying support surface of the stationary lift device 10.

Figure 5:
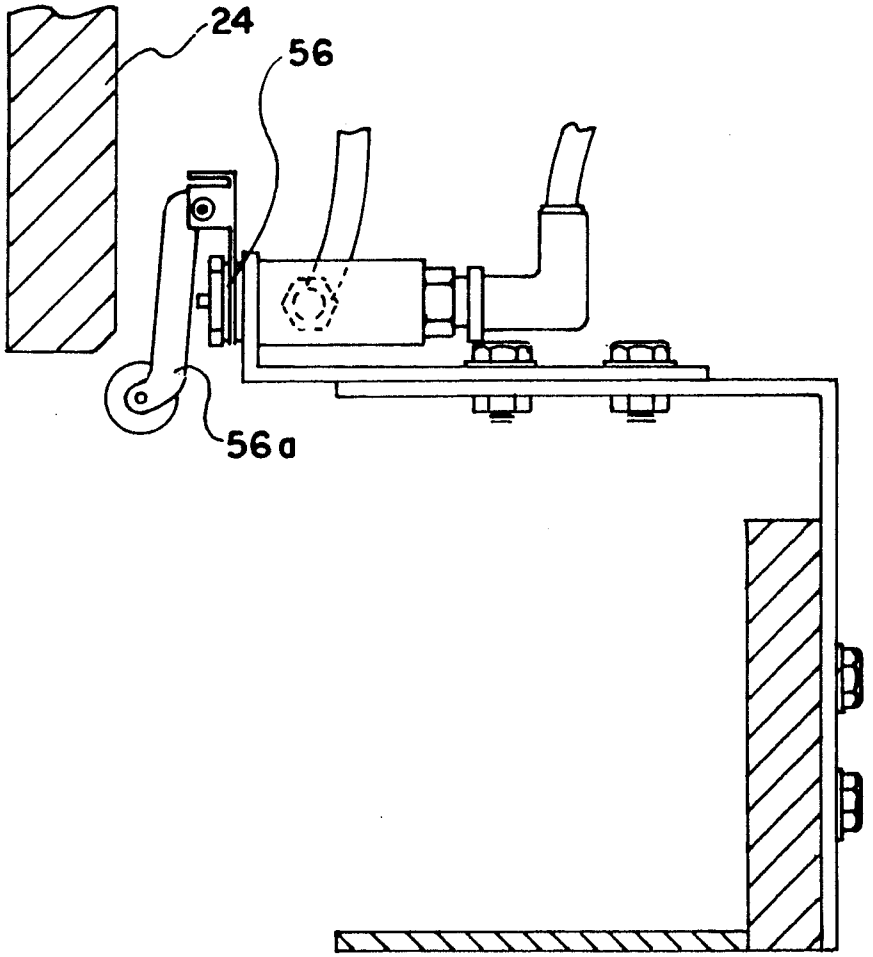
FIG. 5 is a fragmentary sectional view showing the roller switch that forms a part of the fluid drive system that controls the downward descent of the load bed structure of the lift device.

The fluid drive system and the hydraulic cylinder 30 are designed such that the load bed structure 28 is lowered by gravity. Essentially by appropriately positioning control handle 51, the fluid within the hydraulic cylinder 30 is permitted to flow therefrom and that results in the piston being retracted into the cylinder 30 and the load bed structure 28 slowly descending. But for safety reasons it is advantageous to halt the movement of load bed 28 before it actually contacts the underlying floor or surface. To accomplish this the present invention incorporates a load bed stopping mechanism that effectively stops the descent of the load bed structure 28 at a pre-determined distance above the underlying floor or support structure. This is achieved by a manual control line 54 that is tied in with the fluid drive system 40. Manual control line 54 leads to an override button 54*a*. The override button 54*a* and manual control line 54 are associated with a roller switch 56. Roller switch 56 includes a roller switch arm 56*a* that is shown in FIG. 5. The roller switch arm 56*a* is designed to be actuated by the cross member 24 during a portion of this downward descent. The roller switch arm 56*a* effectively closes a valve in the fluid drive system 40 that causes the descent of the load bed structure 28 to be halted. Once the descent of load bed 28 has been halted at a selected height above the support surface or floor then in order to move load bed 28 on downwardly to the floor level, an operator has to engage the manual override button 54*a* and hold the same in an actuated mode for the complete time period required for the load bed structure 28 to move from the halted position to the floor or lower support level.

The fluid drive system 40 just described along with much of the structure of the mainframe and carriage structure is enclosed within a sterile housing indicated generally by the numeral 70. In particular, the housing 70 is designed for use in pharmaceutical and medical production facilities and in a preferred embodiment would be constructed of stainless steel. Viewing the housing 70 in more detail, it is seen that the same includes a back wall 72 that includes a pair of laterally spaced elongated vertical openings 74. It is appreciated that the arms 26 that form a part of the load bed structure 28 and which are connected to the cross member 24 project rearwardly through these vertical openings 74.

It is appreciated that it is important to maintain the vertical opening 74 in a closed state to the extent that is practically possible. In order to achieve this there is a flexible filler strip 76 secured at one end to the cross member 24 just rearwardly of a respective vertical opening 74. Each filler strip extends upwardly from the cross member 24 closely adjacent the vertical opening 74 so as to close the same. Note in the drawings and particularly FIG. 1 where the filler strip curves back under a top portion of the housing 70. It is thusly appreciated that as the cross member 24 and load bed structure move upwardly that each respective filler strip 76 moves upwardly also and tends to curve around the top of the housing 70 and is enclosed by that housing structure.

As the cross member 24 moves upwardly it is appreciated that the lower portion of the vertical opening 74 becomes increasingly open. To close the opening 74 below the cross member there is provided a pair of closure strips 78 that are generally stationary and which are pushed closely adjacent the back of the vertical opening 74 so as to close the openings from the bottom up as the cross member 24 and load bed structure 28 move upwardly. Note that behind each closure strip 78 is a coil-type spring 80 that engages the back side of a respective closure strip 78 and pushes the same into closed engagement with the lower portion of a respective vertical opening 74. In addition, there is provided leaf spring 79 that engages the closure strip 78 and biases the same towards a closed position.

Secured to each side of the load bed structure 28 is a skirt assembly indicated generally by the numeral 100. Skirt assembly 100 includes an upper skirt 102 that is fixed to a respective arm 26. Movably mounted to the upper skirt 102 is a lower skirt 104. As seen in the drawings, there are elongated slots in the upper skirt 102 that allow the lower skirt 104 to move relative to the upper skirt. In particular, as the lower skirt 104 first engages the floor or underlying support it is appreciated that the upper skirt 102 may continue to move downwardly causing the upper and lower skirts 102 and 104 to overlap. This is a safety feature that has a tendency to warn a bystander of the downwardly descending load bed structure 28 if per chance his or her foot lies in the path of the skirt assembly 100.

The stationary lift structure 10 of the present invention is provided with a pair of arms 120 that are connected to the base frame structure and particularly to the base legs 12 and 14 and project over the load bed structure 28 when the same is in the lower extreme position. An opening 122 is provided in the upper portion of each arm 120. A rod 124 is provided that can be inserted into the openings 122. It is thusly appreciated that this permits the base mainframe to be effectively tied to the load bed structure 28. Consequently with the rod 124 secured between the arms 120 as shown in FIG. 1, it is appreciated that the entire lift structure 10 can be picked up off the floor by simply engaging the underside of the load bed structure 28 and particularly the lift arms 26.

Figure 6:
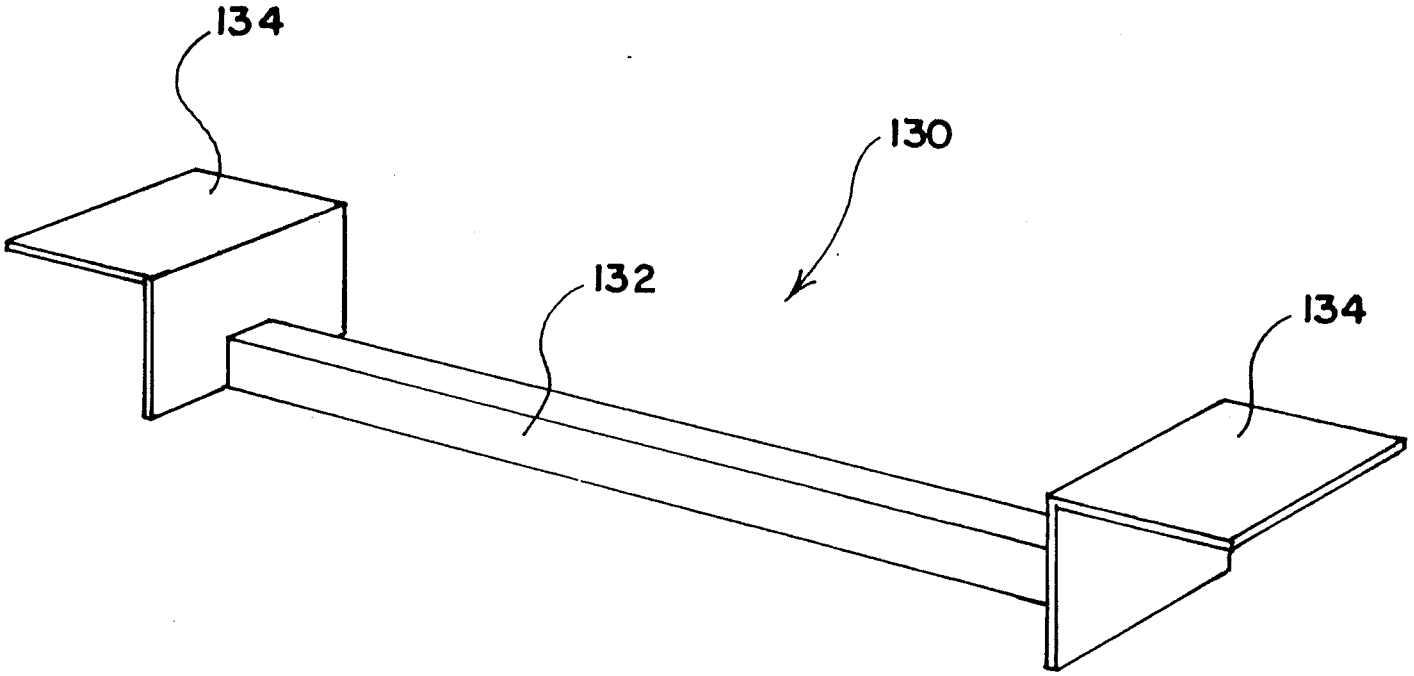
FIG. 6 is a perspective view of a carrier assembly utilized in transporting the lift device of the present invention from one location to another.

To facilitate the mobility of the stationary lift device 10 when the same is being picked up by another forklift, there is provided a carrier assembly indicated by the numeral 130 (FIG. 6). The carrier assembly effectively fits between the base legs 14 and 16 and the load bed structure 28. As seen in the drawings, the carrier assembly 130 includes a carrier bar 132 and a pair of end carrier plates 134 that fit between the arms 26 of the load bed structure 28 and the legs 14 and 16 of ht base mainframe. It is appreciated that when the entire stationary lift is picked up by a forklift, the forks of the lift are inserted underneath the carrier bar 132.

From the foregoing discussion, it is appreciated that the present invention entails an efficient and effective stationary lift device that is of a sterile and clean design which makes the entire lift structure particularly suited for sterile and clean environments such as those required in pharmaceutical and medical production facilities.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A stationary lift device for raising and stationing articles at a selected elevation above a supporting surface a) a mainframe adapted to rest on the supporting surface and including a base frame structure and a pair of upstanding guide rails;

b) a carriage movably mounted on the guide rails and movable up and down between a lower position and an upper position;

c) a horizontal bed structure fixed to the carriage and extending outwardly therefrom and including a pair of laterally spaced arms fixed to the carriage and a bed extending between the arms;

d) a fluid drive system for driving the carriage and the bed structure from the lower position to the upper position; and e) a coupler for coupling the mainframe to the bed structure such that the mainframe and bed structure are tied together and wherein the entire stationary lift device can be raised upwardly off the supporting surface by engaging and raising the bed structure.

2. The stationary lift device of claim wherein the coupler includes a pair of opposed arms with each arm fixed to the base frame of the mainframe and extending upwardly and outwardly of the bed structure; each arm including an upper end having an opening formed therein and wherein the coupler includes a connecting bar connected between the pair of arms with the connecting bar extending through the openings within the upper ends of the arms and with the connecting bar extending over the bed structure thereby essentially preventing the bed structure from moving with respect to the mainframe.

3. The stationary lift device of claim 1 wherein the same is provided with a separate carrier bar for fitting between the mainframe and the bed structure wherein the carrier bar includes an elongated central bar and a carrier plate secured to each end thereof with each carrier plate being adapted to be inserted between the base of the mainframe and the bed structure and wherein the carrier bar is adapted to rest over the fork of a mobile fork lift that is employed to move the entire stationary lift device.

4. The stationary lift device of claim 1 including a housing structure that encloses the guide rails of the mainframe, the carriage, and fluid drive system and includes a back wall having a pair of laterally spaced vertical openings formed therein and wherein the laterally spaced arms of the bed structure project through the vertical openings in the back wall of the housing structure; and wherein there is provided a movable filler strip for each vertical opening and wherein each filler strip is movable with the carriage and is sufficiently flexible to wind around the interior of the housing structure as the carriage and bed structure move upwardly from its lower position.

5. The stationary lift device of claim 4 including a closure strip disposed within the housing structure and adjacent a respective vertical opening for closing a portion of the vertical opening as the bed structure moves upwardly on the guide rails.

6. The stationary lift device of claim 1 wherein the fluid drive system includes an automatic cut-off switch responsive to the vertical movement of the bed structure for limiting the vertical movement of the bed structure.

7. The stationary lift device of claim 6 wherein the fluid drive system includes means for automatically stopping the bed structure at a selected height above the support surface as the bed structure moves downwardly.

8. The stationary lift device of claim 7 wherein the fluid drive system includes manual control means for controlling the final downward movement of the bed structure from its stopped position at the selected height above the support surface thereby assuring that the load bed does not automatically move to its lowermost position without an operator exercising manual control.

9. The stationary lift device of claim 5 further including a pair of laterally spaced springs mounted to the mainframe structure and projecting outwardly for engaging the closure strip and maintaining the closure strip closely adjacent the vertical opening so as to close the lower portions of the vertical openings that are left open by the bed structure being raised to an elevated position.

10. The stationary lift device of claim 1 wherein each side of the bed structure is provided with a collapsing skirt assembly, each collapsing skirt assembly including an upper skirt fixed to a side portion of the bed structure and a lower movable skirt secured to the upper skirt but movable with respect thereto such that as the lower skirt engages the support surface the upper skirt may continue to move downwardly such that the upper and lower skirts tend to collapse together.

11. A stationary lift device for raising and stationing articles at a selected elevation above a supporting surface comprising:

a) a mainframe adapted to rest on the supporting surface and including a base frame structure and a pair of upstanding guide rails;

b) a carriage movably mounted on the guide rails and movable up and down between a lower position and an upper position;

c) a horizontal bed structure fixed to the carriage and extending outwardly therefrom and including a pair of laterally spaced arms fixed to the carriage and a bed extending between the arms;

d) a fluid drive system for driving the carriage and the bed structure from the lower position to the upper position;

e) a coupler for coupling the mainframe to the bed structure such that the mainframe and bed structure are tied together and wherein the entire stationary lift device can be raised upwardly off the supporting surface by engaging and raising the bed structure; and f) the coupler including a pair of arms fixed to frame of the main frame structure and extending generally upwardly therefrom with the arms extending outwardly of the bed structure, an opening formed in the top portion of each arm, and a cross bar connected between the arms and extending through the openings formed therein with the cross bar lying directly above the horizontal bed so as to effectively couple the base frame of the main frame to the horizontal bed such that by engaging an underside of the bed and raising said bed the entire stationary lift device including the mainframe can be raised and the stationary lift can be moved from one location to another.

12. A stationary lift device for raising and stationing articles at a selected elevation above a supporting surface comprising:

a) a mainframe adapted to rest on the supporting surface and including a base frame structure and a pair of upstanding guide rails;

b) a carriage movably mounted on the guide rails and movable up and down between a lower position and an upper position;

c) a horizontal bed structure fixed to the carriage and extending outwardly therefrom and including a pair of laterally spaced arms fixed to the carriage and a bed extending between the arms;

d) a fluid drive system for driving the carriage and the bed structure from the lower position to the upper position;

e) a sterile housing for enclosing the carriage, and at least a substantial part of the fluid drive system;

f) the sterile housing including a front and back sterile wall with the back wall including a pair of laterally spaced elongated openings and wherein the arms of the bed structure project through those openings and move up and down therein;

g) a pair of filler strips fixed to the horizontal bed structure and movable up and down therewith, each filler strip being disposed adjacent a respective elongated opening formed in the back wall of the sterile housing for filling the elongated open end portion that extends above the horizontal bed, and wherein the filler strips are sufficiently flexible that they may bend and flex and be curled interiorly of the sterile housing as the horizontal bed structure moves upwardly with the carriage; and h) a pair of closure strips mounted within the sterile housing adjacent the vertical openings formed in the back wall thereof and wherein each closure strip is disposed adjacent a respective vertical opening within the back wall of the sterile housing and wherein there is provided means for biasing the respective closure strips towards a position where the closure strips close a lower portion of the respective elongated openings formed within the back wall of the sterile housing as the horizontal bed structure moves upwardly.

* * * * *